United States Patent [19]

Schriber

[11] 4,006,361

[45] Feb. 1, 1977

[54] X-RAY BEAM FLATTENER

[75] Inventor: Stanley O. Schriber, Deep River, Canada

[73] Assignee: Atomic Energy of Canada Limited, Ottawa, Canada

[22] Filed: Mar. 3, 1975

[21] Appl. No.: 555,047

[30] Foreign Application Priority Data

Dec. 18, 1974 Canada ..... 216333

[52] U.S. Cl. ..... 250/510

[51] Int. Cl.[2] ..... H05G 3/00

[58] Field of Search ..... 250/505, 510, 514

[56] References Cited

UNITED STATES PATENTS

| | | | |
|---|---|---|---|
| 3,752,990 | 8/1973 | Fischer | 250/510 |
| 3,767,931 | 10/1973 | Williams | 250/505 |
| 3,873,824 | 3/1975 | Bean | 250/505 |
| 3,892,973 | 7/1975 | Coquin | 250/505 |

*Primary Examiner*—Craig E. Church
*Attorney, Agent, or Firm*—Edward Rymek

[57] ABSTRACT

An X-ray beam flattener of predetermined symmetrical shape for attenuating the radiation intensity of the beam in decreasing amounts as the angle from the central axis increases. The symmetrical shape is made from a low Z, high density material such as $Al_2O_3$, BeO, $BeAl_2O_4$, $B_4C$ or SiC. A further thin layer of high Z material may be coated on the forward end of the symmetrical shape to absorb low energy photons.

4 Claims, 4 Drawing Figures

X-RAY BEAM FLATTENER

The invention is related to X-ray beam flatteners and in particular to an improved beam flattener which will equalize the angular distribution of the radiation over a specific area.

Radiation from the target in a bremsstrahlung process is usually strongly forward peaked. However, for therapeutic as well as industrial applications, it is desirable to have a flat dose rate angular distribution over a specific area. The flat distribution is achieved by attenuating the radiation in decreasing amounts as the angle from the central axis increases by means of a cone-shaped device which is positioned symmetrically about the axis of the X-ray beam between the beam source and the patient or object to be irradiated.

Presently lead or aluminum are the usual materials used as flatteners. Because lead is a high Z material, the flattener may be short, however, it tends to soften the radiation, decreasing the effective energy of the X-ray beam. On the other hand, an aluminum flattener which is a low Z material, does not soften the beam, but is prohibitively long, especially in high energy therapeutic applications where space is a major problem.

It is therefore an object of this invention to provide an improved X-ray beam flattener.

It is a further object of this invention to provide a beam flattener which will harden the bremsstrahlung radiation.

It is a further object of this invention to provide a short and effective beam flattener.

These and other objects are achieved by providing an X-ray beam flattener or predetermined shape for attenuating the radiation intensity of the beam in decreasing amounts as the angle from the central axis increases, which is made from a low Z material which has a high density. The Bremsstrahlung radiation will be hardened due to the low Z characteristic of the material and the length of the flattener is limited due to the high density characteristic of the material. Flatteners in accordance with this invention may be made from beryllium oxide (BeO), berryllium aluminate ($BeAl_2O_4$), boron carbide ($B_4C$), silicon carbide (SiC) or aluminum oxide ($Al_2O_3$).

A further thin layer of high Z material such as gold or tungsten may be positioned in the forward direction with respect to the symmetrically shaped low Z material to absorb low energy photons in the X-ray beam before it exits the beam flattener.

Figure 1:
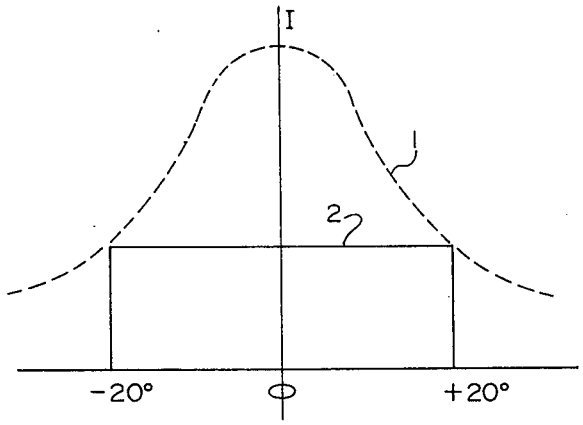
FIG. 1 is a plot of radiation intensity of an X-ray beam vs the angle from the central axis.

In FIG. 1, the intensity of the forward radiation for a typical X-ray source is illustrated by dotted line 1. The desired intensity of forward radiation is illustrated by solid line 2. The desired forward radiation may be achieved by aluminum or lead flatteners which usually have the general shapes shown in FIGS. 2 and 3.

Figure 2:
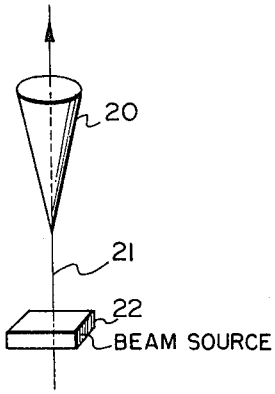
FIG. 2 PRIOR ART
FIG. 2 illustrates a beam flattener having a first shape.
Figure 3:
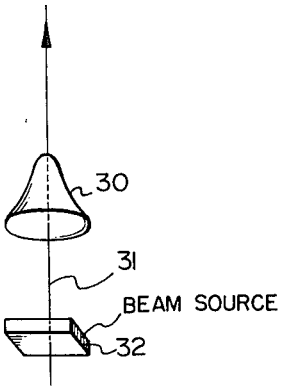
FIG. 3 PRIOR ART
FIG. 3 illustrates a beam flattener having a second shape.

In FIG. 2, the flattener 20 is cone-shaped and positioned concentrically about the axis 21 of the X-ray beam produced by source 22. The apex of the flattener is closer to the source 22. In FIG. 3, the flattener 30 is bell shaped and positioned about the axis 31 of the X-ray beam produced by source 32. The base of the flattener is closest to the source 32.

A beam flattener in accordance with this invention may take any one of the same general shapes used in prior art flatteners, such as those illustrated in FIGS. 2 and 3, however, it will be made from a high density, low Z material, i.e. a material having an atomic number $Z<25$. The low Z characteristic of the material results in greater attenuation of low energy photons than of high energy photons. This produces a hardening of the radiation spectrum. The high density characteristics allows for the manufacture of short and yet effective beam flatteners since the high density of the material does not degrade the quality of the X-ray beam. Certain compounds such as aluminum oxide ($Al_2O_3$), beryllium oxide (BeO), beryllium aluminate ($BeAl_2O_4$), boron carbide ($B_4C$), and silicon carbide (SiC) which have a density in grams/cm$^3$ of 3.97, 3.01, 3.76, 2.52 and 3.22 respectively are ideally suited for inclusion in flatteners in accordance with this invention, since they have a low Z and a high density and, in addition, are radiation resistant and machinable.

As an example, an $Al_2O_3$ right circular cone flattener, having a length of approximately 20 cm will flatten a 25 MeV beam for a circular area having a 40 cm diameter, which is 100 cm from the radiation source.

Figure 4:
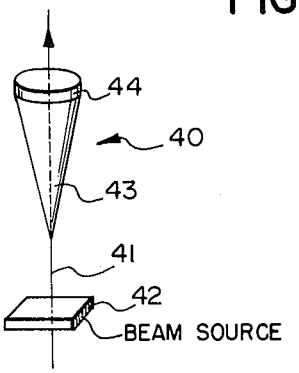
FIG. 4 illustrates a beam flattener in accordance with this invention.

In a further improvement shown in FIG. 4, a beam flattener 40 may consist of a low Z, high density cone-shaped material 43 which is symmetrically positioned about the axis 41 of an X-ray beam produced by source 42, the apex of the cone being closest to the source. The base surface of the cone-shaped material which is facing the irradiated object is coated with a thin layer 44 of high Z material, i.e., a material having an atomic number $Z>58$, such as tungsten or gold. Layer 44 further absorbs low energy photons in such a manner that the entrance radiation dose at the radiated object, due to the low energy photons, i.e. $<1$MeV, will not be greater than that from the higher energy photons, i.e. $>1$MeV. This layer would be approximately 0.06 g/cm$^2$ thick.

The thin layer of high Z material may be used with beam flatteners in accordance with this invention having shapes other than the one shown in FIG. 4, however, it is always positioned between the end of the beam flattener and the irradiated object. In addition, the thin layer is preferrably coated onto the low Z, high density material in the beam flattener.

I claim:

1. In an X-ray apparatus having a beam source for producing a strongly forward peaked bremsstrahlung radiation beam about a central beam axis, said beam including photons with energies $>1$ MeV, an X-ray beam flattener comprising:

a low atomic number high density material on the central axis for preferentially attenuating low energy photons in the X-ray beam passing through said material, said material having a predetermined shape for attenuating the radiation intensity of said beam in decreasing amounts as the angle from the central axis increases, wherein said low Z material has an atomic number $Z < 25$ and a density $>3.0$ gm/cm$^3$ and is selected from the group consisting of $Al_2O_3$, BeO, $BeAl_2O_4$, and Sic; and a thin layer of high Z material positioned in the forward direction with respect to said low Z material for absorbing low energy photons in said X-ray beam, wherein said high Z material has an atomic number $Z > 58$.

2. The apparatus as claimed in claim 1 wherein said predetermined shape is symmetrical about said central axis.

3. The apparatus as claimed in claim 1 wherein said thin layer is coated on said low Z material to a thickness of 0.06 g/cm$^2$.

4. The apparatus as claimed in claim 3 wherein said high Z material is tungsten or gold.

* * * * *